United States Patent [19]

Hasircoglu

[11] Patent Number: 4,632,486

[45] Date of Patent: Dec. 30, 1986

[54] INSULATION DISPLACEMENT COAXIAL CABLE TERMINATION AND METHOD

[75] Inventor: Alexander W. Hasircoglu, Lancaster, Pa.

[73] Assignee: E. I. Du Pont de Nemours and Company, Wilmington, Del.

[21] Appl. No.: 739,031

[22] Filed: May 29, 1985

[51] Int. Cl.[4] ..... H01R 4/24

[52] U.S. Cl. ..... 339/99 R; 339/177 R

[58] Field of Search ..... 339/97 R, 97 P, 98, 339/99 R, 177

[56] References Cited

U.S. PATENT DOCUMENTS

| | | | |
|---|---|---|---|
| 3,444,506 | 5/1969 | Wedekind | 339/99 R |
| 3,530,425 | 9/1970 | Vachhani | 339/95 |
| 3,601,768 | 8/1971 | Lightner | 339/103 M |
| 3,685,006 | 8/1972 | Jerrold-Jones | 339/177 R |
| 3,836,946 | 9/1974 | Geiger | 339/177 R |
| 3,963,319 | 6/1976 | Schumacher et al. | 339/99 R |
| 3,994,554 | 11/1976 | Navarro | 339/99 R |
| 4,201,432 | 5/1980 | Chalmers | 339/14 R |

FOREIGN PATENT DOCUMENTS

| | | | |
|---|---|---|---|
| 27696 | 4/1981 | European Pat. Off. | 339/99 R |

*Primary Examiner*—Joseph H. McGlynn

[57] ABSTRACT

Coaxial cables made up a plurality of co-planar individual coaxial cables, each having a signal wire and a coaxial conductive sheath including a ground wire co-planar with the signal wires, are terminated by inserting the end of the cable in a housing for receiving an array of insulation displacement contacts along an axis transverse to the plane of the cable. Each signal wire and each ground wire is electrically contacted by a respective one of the insulation displacement contacts. The cable is secured to the housing, and the housing is secured to the structure which supports the contacts.

7 Claims, 9 Drawing Figures

FIG. 4
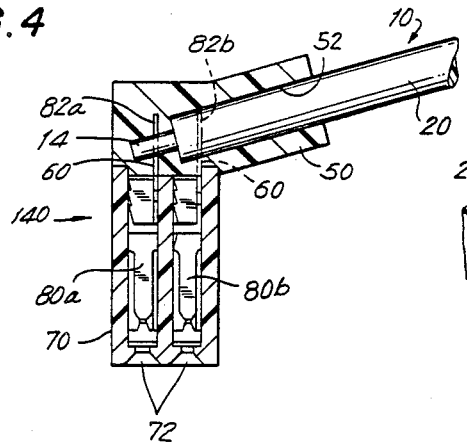
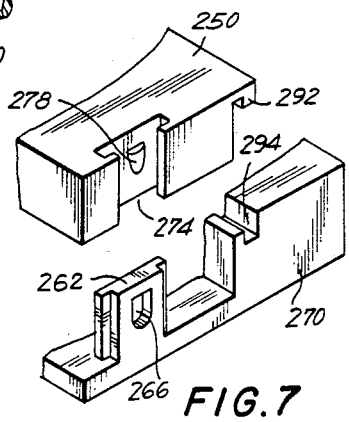
FIG. 7
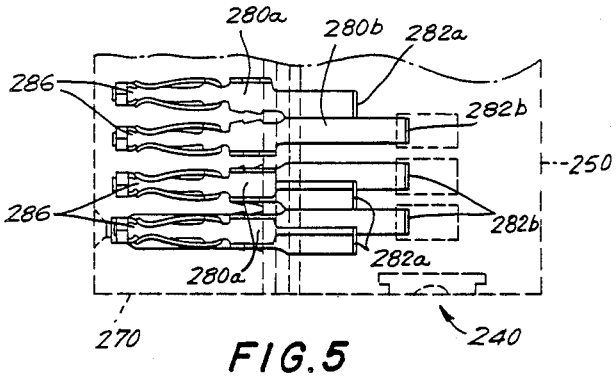
FIG. 5
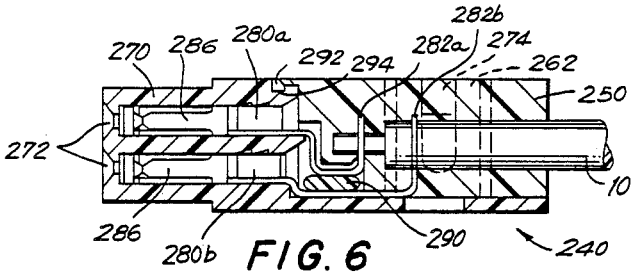
FIG. 6

INSULATION DISPLACEMENT COAXIAL CABLE TERMINATION AND METHOD

BACKGROUND OF THE INVENTION

This invention relates to terminations (e.g., connectors) for coaxial cables, and more particularly to terminations for cables made up of several co-planar signal wires, each of which has its own coaxial shield including a ground wire in the plane of the signal wires.

Cables made up of several individual coaxial cables joined together in one planar assembly (sometimes referred to herein as ribbon coaxial cables) are being increasingly employed in sophisticated electronic equipment such as computers. The cables of interest here are those in which each shield structure includes a ground wire in the plane of the signal wires. These cables are typically relatively small (e.g., 12 signal wires and associated coaxial shields in a ribbon 1.2 inches wide). The task of physically separating and terminating such a large number of closely spaced signal wires and shields in order to connect the cable to other apparatus such as a printed circuit board or connector is tedious, time consuming, subject to error, and costly.

It is therefore an object of this invention to provide improved and simplified termination methods and apparatus for coaxial cables of the type described above.

It is a more particular object of this invention to provide improved and simplified connectors and connector methods for coaxial cables of the type described above.

SUMMARY OF THE INVENTION

These and other objects of the invention are accomplished in accordance with the principles of the invention by providing a housing for receiving and retaining the end of a ribbon coaxial cable. The ends of the coaxial shields are recessed from the ends of the associated signal wires. The housing with the ribbon coaxial cable in place is then pressed down on an array of insulation displacement contacts. The insulation displacement contacts are typically arranged in two parallel rows, each row being parallel to the end of the cable. The contacts in one row are the signal wire contacts, and these are located between the ends of the signal wires and the recessed ends of the coaxial shields. The contacts in the other row are the shield or ground wire contacts, and these are located upstream from the recessed ends of the coaxial shields. The spacing of the signal wire contacts and ground wire contacts is such that each signal wire contact intersects and therefore contacts a respective one of the signal wires when the housing is pressed down on the contact array, and so that each ground wire contact similarly intersects and contacts a respective one of the ground wires which form part of the coaxial shields. The signal wire contacts contact the signal wires by displacing the insulation around those wires. The ground wire contacts contact the ground wires by similarly displacing the insulation and coaxial shield material adjacent the ground wires. The housing is secured in place relative to the insulation displacement contact array by any suitable means such as latches operating between the housing and the structure which supports the contact array.

Further features of the invention, its nature and various advantages will be more apparent from the accompanying drawings and the following detailed description of the invention.

BRIEF DESCRIPTION OF THE DRAWINGS

FIG. 4 is a view similar to FIG. 3 showing an alternative embodiment of the invention.

FIG. 5 is a partial plan view of another alternative embodiment of the invention.

FIG. 6 is a view similar to FIGS. 3 and 4 for the embodiment of FIG. 5.

FIG. 7 is a perspective view of a portion of the embodiment of FIGS. 5 and 6.

DETAILED DESCRIPTION OF THE INVENTION

Figure 8:
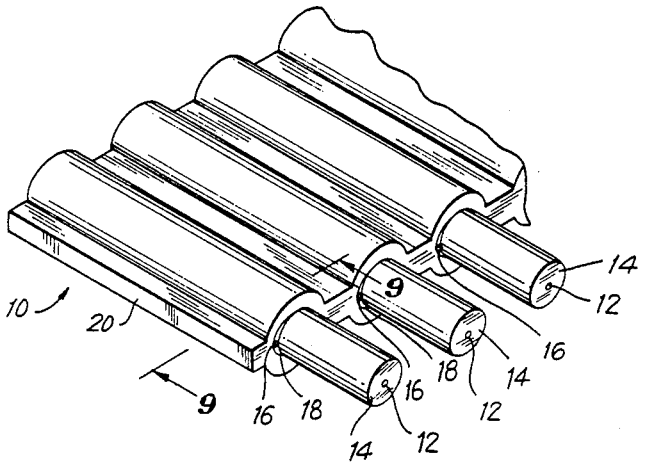
FIG. 8 is a perspective view of part of an illustrative ribbon coaxial cable prepared for use in accordance with this invention.
Figure 9:
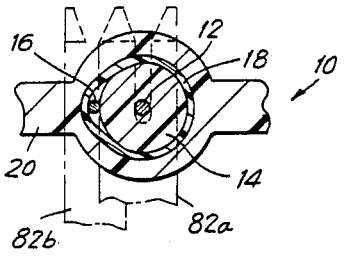
FIG. 9 is a partial cross sectional view taken along the line 9—9 in FIG. 8 and indicating the manner in which the signal and ground wires are terminated in accordance with the invention.

As is best seen in FIGS. 8 and 9, a typical conventional ribbon coaxial cable includes a plurality of co-planar, parallel, laterally spaced signal wires 12, each of which is surrounded by an insulating layer 14 of expanded polyurethane, polytetrafluorethylene, or similar material. In the plane of signal wires 12 and just outside the insulating layer 14 of each signal wire is a ground wire 16. (In some cables, two ground wires are associated with each signal wire, one ground wire being located on each side of the associated signal wire. This invention is equally applicable to such cables.) Each structure 12, 14, and 16 is surrounded by a conductive sheath 18 substantially coaxial with the associated signal wire 12 and in electrical contact with the associated ground wire 16. Conductive sheaths 18 may be metalized Mylar ® (registered trademark of E. I. du Pont de Nemours & Company, Incorporated), aluminum foil, or a similar material. All of elements 12, 14, 16, and 18 are enclosed within a single outer insulating jacket 20 of polyvinylchloride or similar material.

Although the invention is equally applicable to terminating cable 10 at other devices such as an insulation displacement contact field on a printed circuit board, the invention will be fully understood from an explanation of its application to terminating cable 10 at connectors which can be plugged into mating connectors for connecting cable 10 to other cables or devices.

The end of cable 10 to be terminated in accordance with this invention is preferably cut off perpendicular to the longitudinal axis of the cable. The ends of conductive sheaths 18 must be recessed a predetermined distance from the ends of signal wires 12. This is preferably done by recessing the ends of all of elements 16, 18, and 20 relative to the ends of elements 12 and 14 as shown in FIG. 8.

Figure 1:
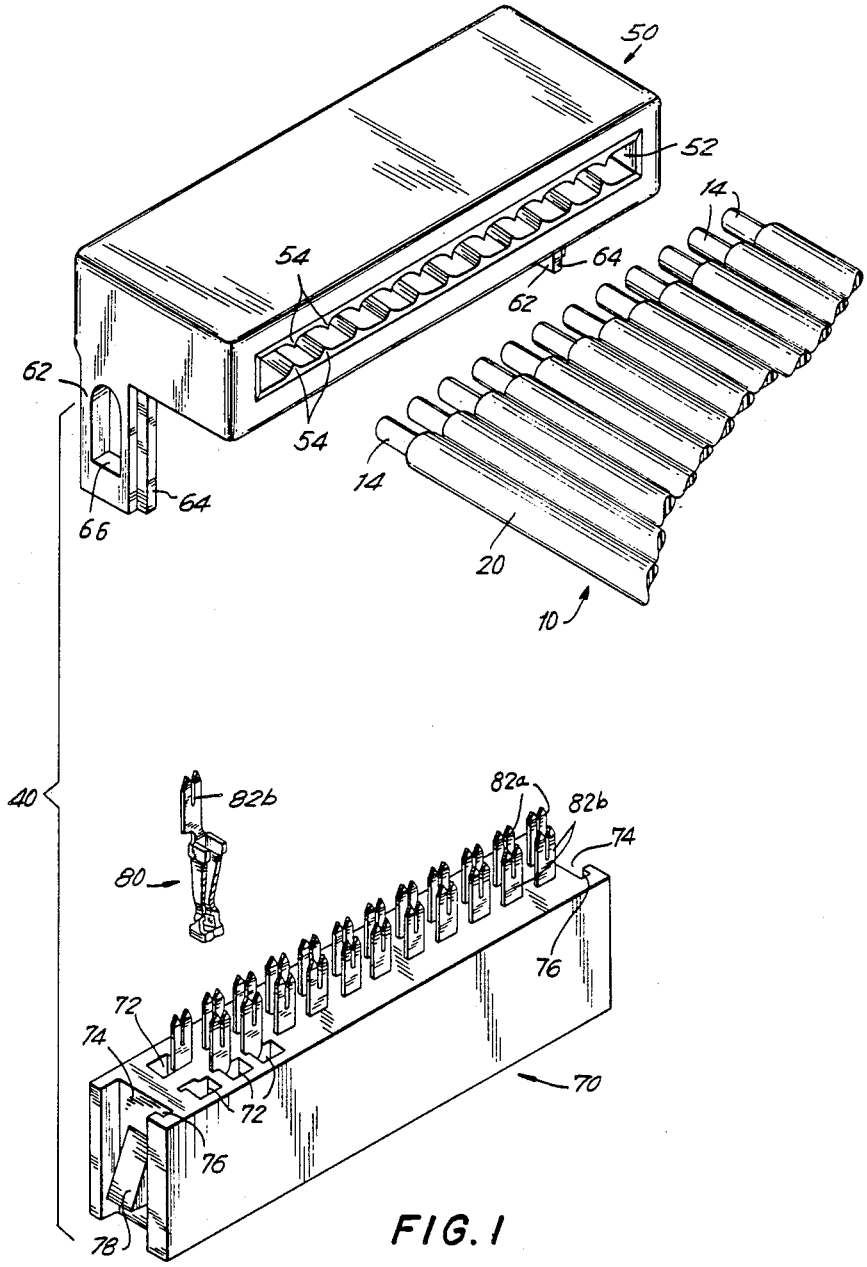
FIG. 1 is a partially exploded illustrative embodiment of a connector constructed in accordance with the principles of the invention.
Figure 2:
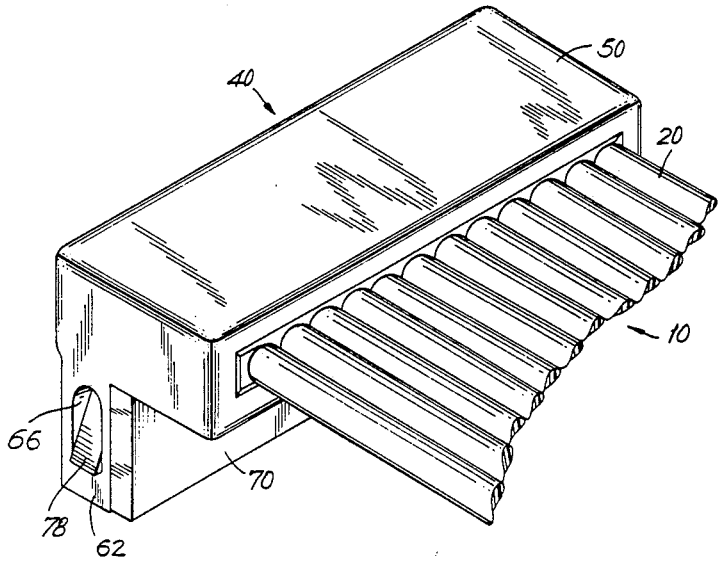
FIG. 2 is a perspective view of the connector of FIG. 1 after assembly in accordance with the invention.
Figure 3:
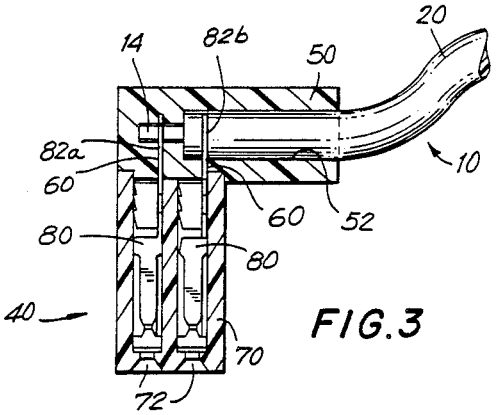
FIG. 3 is a cross sectional view of the connector of FIGS. 1 and 2.

A first illustrative connector 40 constructed and assembled in accordance with this invention is shown in FIGS. 1–3. Connector 40 includes a first housing part 50 which is basically a block of insulating material such as polyvinylchloride having an aperture 52 in one side for receiving the end of cable 10. Aperture 52 is preferably sized and shaped so that it is just large enough to easily receive the end of cable 10 and so that it guides each individual coaxial cable in cable 10 into a predetermined location in housing 50. In the depicted embodiment, this guiding function is provided in part by inwardly projecting ribs 54 which project into aperture 52 and which extend parallel to the longitudinal axis of cable 10. Ribs 54 fit into the longitudinal grooves in insulating jacket 20 between the individual coaxial cables in cable 10.

Aperture 52 is deep enough in the direction parallel to the longitudinal axis of cable 10 to receive both the unshielded end portions of elements 12 and 14 (i.e., the portions of those elements beyond the recessed ends of elements 16, 18, and 20), and a shielded portion of elements 12 and 14 (i.e., a portion of cable 10 including all of elements 12, 14, 16, 18, and 20 intact). Aperture 52 is preferably provided with surfaces perpendicular to the longitudinal axis of cable 10 against which the ends of one or more of elements 12, 14, 16, 18, and 20 seat when the cable is inserted in aperture 52 to the above-described desired degree.

Means are provided for securing cable 10 in aperture 52. For example, assuming that insulating jacket 20 and housing 50 are both compatible with the same adhesive, that adhesive can be applied to one or both of the end of jacket 20 and the inside of aperture 52 prior to insertion of the end of cable 10 in aperture 52. When the adhesive cures, cable 10 is permanently secured in aperture 52.

One side of housing 50 which is parallel to the plane of cable 10 has other apertures 60 (FIG. 3) which communicate with the bottom portion of aperture 52 containing both the unshield end portions of elements 12 and 14, and a shielded portion of those elements. Apertures 60 are adapted to receive an array or field of insulation displacement contacts 82 projecting from one side of second housing part 70 perpendicular to the plane of cable 10.

Second housing part 70 is basically a block of insulating material such as polyvinylchloride having a plurality of apertures 72 extending therethrough perpendicular to the plane of cable 10. (Some of apertures 72 have been omitted from FIG. 1.) Each aperture 72 contains a metal terminal member 80 having an insulation displacement contact portion 82 at one end. In the depicted embodiment, terminals 80 are female terminals for removably receiving male terminal pins (not shown) via the ends of the terminals remote from portions 82.

Apertures 72, and therefore projecting insulation displacement contacts 82, are arranged in two parallel rows, parallel to the end of cable 10. Whereas adjacent apertures 72 in the two rows are directly opposite one another, the insulation displacement contacts **82*a* in one row are offset from the insulation displacemnet contacts 82*b* in the other row for reasons which will become apparent as the description proceeds. This offsetting of one row of contacts 82 relative to the other row is achieved by using in one row terminals 80 having contacts 82 which are offset to one side, while in the other row terminals 80 are used which have contacts 82** offset to the other side.

When the field of contacts 82 is inserted into apertures 60, each of contacts **82*a* is positioned to intersect a respective one of signal wires 12 beyond the recessed ends of members 16, 18, and 20. Similarly, each of contacts 82*b* is positioned to intersect a respective one of ground wires 16. Accordingly, contacts 82*a* are sometimes referred to as signal wire contacts, and contacts 82*b* are sometimes referred to as ground wire contacts. Each of signal wire contacts 82*a* displaces the insulating sheath 14 around the associated signal wire 12 and pinches the signal wire in the cleft of the contact to assure a good electrical connection between the contact and the signal wire (see FIG. 9). Each of ground wire contacts 82*b* pierces insulating jacket 20 and conductive sheath 18 and displaces a portion of insulating sheath 14 in order to receive and pinch the associated ground wire 16 in the cleft of the contact. As is apparent from FIG. 9, ground wire contacts 82*b* are sufficiently narrow (in the plane perpendicular to the longitudinal axis of cable 10) so that each ground wire contact does not touch either the signal wire 12 associated with the ground wire 16 to which the contact is connected or the conductive sheath 18** associated with the adjacent signal wire. (If cables having two ground wires per signal wire are used, only one ground wire associated with each signal wire is terminated, exactly as described above.)

Housing parts 50 and 70 preferably include complementary structures for guiding the two housing parts together so that contacts 82 are properly oriented and located to contact wires 12 and 16 in the intended manner. For example, in the depicted embodiment, a tab 62 extends from housing part 50 at each end of the connector. The longitudinal axes of tabs 62 are parallel to one another and perpendicular to the plane of cable 10. These longitudinal axes are also parallel to the connector axis along which housing parts 50 and 70 are moved relative to one another to bring those parts together to thereby interconnect contacts 82 and wires 12 and 16 as described above. Each of tabs 62 fits in a respective one of slots 74 in the ends of housing part 70 as the two housing parts are brought together. Tabs 62 and slots 74 are shaped so that housing part 70 can only go together with housing part 50 with signal wire contacts **82*a* closer to the bottom of aperture 52 than ground wire contacts 82*b*. This orientation function of elements 62 and 74 is performed by a key 64 on the side of each tab 62 remote from the bottom of aperture 52, and by a complementary keyway 76 on the side of each slot 74 closer to ground wire contacts 82*b*. Accordingly, elements 62 and 74 cooperate to guide housing parts 50 and 70 together with contacts 82 properly oriented and located to make the desired connections with wires 12 and 16**.

After housing parts 50 and 70 have been brought together as described above, they are preferably secured together to prevent disconnection of contacts 82 and wires 12 and 16. In the depicted embodiment this function is performed by cooperating latching elements on tabs 62 and slots 74. In particular, when housing parts 50 and 70 are seated together, lugs 78 in slots 74 project into apertures 66 in tabs 62 and hold housing parts 50 and 70 together. Other means such as adhesives could alternatively be used to secure hosuing parts 50 and 70 together.

The connector axis along which housing parts 50 and 70 are moved relative to one another to assemble the connector need not be exactly perpendicular to the plane of cable 10 as in the above-described embodiment. FIG. 4 illustrates an alternative embodiment in which the plane of signal wire contacts **82*a* and the parallel plane of ground wire contacts 82*b* are both transverse but not perpendicular to the plane of cable 10. In particular, the angle between the planes of the contact rows and the plane of cable 10 is approximately 105 degrees. This may facilitate using connectors 140 more closely together when making connections to other devices. In all other respects, connector 140 is similar to above-described connector 40, and similar reference numbers are applied to corresponding parts of both connectors. The longitudinal axes of tabs 62 (not shown in FIG. 4) and slots 74 (also not shown in FIG. 4) are parallel to the longitudinal axes of contacts 82, which is turn are parallel to the connector axis along which housing parts 50 and 70 are moved relative to one another to assemble connector 140**.

Terminal members 80 need not be straight, as they are in the above-described embodiments. FIGS. 5–7 illustrate another connector 240 in which the interconnection portions 286 of signal terminals 280*a* and ground terminals 280*b* are perpendicular to the insulation displacement contact portions 282*a* and 282*b* of those terminals. Insulating spacer member 290 is provided between signal wire contacts 282*a.* on the one hand, and ground wire contacts 282*b,* on the other hand, to prevent contacts 282*a* from deflecting down against contacts 282*b* during interconnection of housing parts 250 and 270. Apart from these differences—and corresponding adaptations of the shapes of housing parts 250 and 270—connector 240 is basically similar to connector 40. Accordingly, parts in FIGS. 5–7 which are similar to parts in FIGS. 1–3 are identified by similar reference number, the prefix 2 being added in FIGS. 5–7.

In connector 240, insulation displacement contacts 282 are perpendicular to the plane of cable 10 and parallel to the connector axis along which housing parts are moved relative to one another to assemble the connector. Tabs 262 and slots 274 are also parallel to this connector axis. In this embodiment, tabs 262 are on housing part 270 and slots 274 are located in housing part 250. In addition to the latching engagement of elements 266 and 278 (respectively similar to above-described elements 66 and 78), housing parts 250 and 270 are held together parallel to the longitudinal axis of cable 10 by hook-shaped projection 292 from housing part 250 in channel 294 in housing part 270.

Although the invention has been illustrated in its application to cable terminations in the form of plug-type connectors, it will be understood that the invention is equally applicable to cable terminations of other types. For example, insulation displacement contacts 82, arranged as described above, could be permanently mounted on a printed circuit board. A housing part similar to housing part 50 would receive the end of cable 10 in the manner illustrated herein. The housing part would then be pushed down on the insulation displacement contacts to make electrical contact with the signal and ground wires of the cable. The housing part would be secured to the printed circuit board by latches or an adhesive in the same way that housing part 50 is secured to housing part 70 in connector 40. Techniques like those shown and described above could be used for ensuring proper positioning and orientation of cable 10 relative to the insulation displacement contacts.

It is to be understood that the foregoing is only illustrative of the principles of the invention, and that various modifications can be made by those skilled in the art without departing from the scope and spirit of the invention. For example, although female connector terminals 80 and 280 are shown in the drawings, male connector terminals could be used instead if desired.

I claim:

1. A method for mechanically and electrically attaching a cable termination to the end of a cable assembly having (1) a plurality of co-planar, parallel, laterally spaced signal wires, each signal wire being enclosed in a first insulating sheath and having (a) an associated parallel ground wire in the plane of the signal wires outside the first insulating sheath and (b) a conductive sheath surrounding the ground wire and the first insulating sheath, and (2) a second insulating sheath surrounding all of the conductive sheaths, the ends of the conductive sheaths being recessed from the ends of the signal wires, the method comprising the steps of:

inserting the end of the cable assembly in a first housing member;

securing the cable assembly to the first housing member;

bringing the first housing member together with a second housing member having a plurality of parallel, laterally spaced insulation displacement contacts extending from the second housing member in two parallel rows, the insulation displacement contacts in one row being signal wire contacts for respectively electrically contacting the signal wires, and the insulation displacement contacts in the other row being ground wire contacts for respectively electrically contacting the ground wires, the first and second housing members being brought together by relative motion of the housing members along a termination axis transverse to the plane of the signal wires and parallel to the insulation displacement contacts so that each signal wire contact displaces the insulation surrounding a respective one of the signal wires beyond the end of the associated conductive sheath and makes electrical contact with that signal wire, and so that each ground wire contact displaces the insulation and conductive sheath surrounding a respective one of the ground wires and makes electrical contact with that ground wire; and securing the first and second housing members together.

2. The method of claim 1 wherein the cable assembly is inserted into the first housing member along an axis parallel to the signal wires.

3. The method defined in claim 1 wherein the first and second housing members are brought together with the rows of insulation displacement contacts parallel to the end of the cable assembly.

4. The method defined in claim 1 wherein the first and second housing members are brought together with only the signal wire contacts being beyond the recessed ends of the the conductive sheaths.

5. The method defined in claim 1 wherein the termination axis is perpendicular to the plane of the signal wires.

6. The method defined in claim 1 wherein the termination axis forms an angle of approximately 105° with the plane of the signal wires.

7. The method of claim 1 further comprising the step of applying an adhesive to at least one of the cable assembly and the first housing member prior to the inserting step so that the adhesive joins the cable assembly and the first housing member subsequent to the inserting step, and so that the cable assembly and the first housing member are secured to one another by allowing the adhesive to cure.

* * * * *